United States Patent [19]

Havas

[11] Patent Number: 4,811,356

[45] Date of Patent: Mar. 7, 1989

[54] CONTROL CIRCUIT FOR SWITCHING POWER TO AN INDUCTION FURNACE

[75] Inventor: George Havas, Youngstown, Ohio

[73] Assignee: Ajax Magnethermic Corporation, Warren, Ohio

[21] Appl. No.: 166,118

[22] Filed: Mar. 10, 1988

[51] Int. Cl.[4] ..... H05B 1/02; H05B 5/04

[52] U.S. Cl. ..... 373/148; 373/150

[58] Field of Search ..... 373/147, 148, 149, 150; 219/10.75, 10.77; 323/209, 210

[56] References Cited

U.S. PATENT DOCUMENTS 3,478,155 11/1969 Segsworth ..... 373/150

4,037,044 7/1977 Havas ..... 373/150

*Primary Examiner*—Roy N. Envall, Jr.

*Attorney, Agent, or Firm*—Fay, Sharpe, Beall, Fagan, Minnich & McKee

[57] ABSTRACT

A control circuit particularly useful for controlling the application of power to a single phase induction furnace from a normal line frequency power supply is provided. The load has a large inductance and a resistance. A switch, preferably formed from thyristors, is provided in series connection with the furnace load. A first capacitor is provided in parallel connection with the series connected switch and load. A second capacitor is provided in series connection with the series connected switch and load and the first capacitor whereby selective operation of conduction of the switch results in the smooth and continuous control of furnace power. In an alternative embodiment small inductors are placed in series with the capacitors to provide a filter preferably tuned to the fourth harmonic of the power supply.

9 Claims, 2 Drawing Sheets

CONTROL CIRCUIT FOR SWITCHING POWER TO AN INDUCTION FURNACE

BACKGROUND OF THE INVENTION

This invention pertains to the art of electrical control circuits and more particularly to a solid state control circuit for switching a large inductive load.

The invention is particularly applicable to a simple power control circuit which displays desirable operating characteristics especially for loads whose power factor does not vary a great deal over time or does not vary rapidly. For example, a load such as a channel induction furnace which would have essentially the same power factor for months or which would change very slowly, is the type of load that the subject invention is intended to control. However, it will be appreciated by those skilled in the art that the invention could be adapted for use in other environments as, for example, where similar power circuits are employed to control the application of electrical energy to a load.

In the past, most people have refrained from using solid state controls, such as thyristors, for switching the power to induction furnaces because of the great need for reliability of the control circuit to operate the furnace. The risk of power outages, which were to be expected with solid state controls, was unacceptable for powering an induction furnace where the control circuit must operate reliably.

It has been known to employ solid state controls in a part of the control circuit for an induction furnace; however, the solid state switches have been employed to switch capacitors, and have not been employed to switch the power directly to the furnace for the reasons discussed above. In other words, the control has been essentially achieved by connecting the furnace in series with a capacitor and by rapidly switching capacitors in and out, the power to the furnace could be controlled, for example see U.S. Pat. No. 4,037,044 (Havas). A problem with such circuits is that the switching of capacitors with thyristors is a rather difficult thing to do. If the switches are not turned on at the proper time they will self-destruct. Consequently a small error in switching time can have disastrous consequences in the failure of the control circuit. Despite this risk, the prior art systems employed a plurality of thyristors switching an associated plurality of capacitors to effect the rapid switching of the capacitance of the control circuit. The rapid switching, sometimes at a switch per half cycle, required an extremely complicated control circuit which is expensive to produce and maintain.

Another problem with the prior art systems which include thyristors switching a plurality of capacitors is the difficulty such control circuits have in minimizing the potential harmonic resonances in the system. Any such control circuit must constantly be aware of the effect of resonant frequencies which are picked up on the line side or which are generated by the control circuit itself.

Yet another design problem for such induction furnace control circuits is the ability of the circuit to handle shorts. Due to the high power levels involved in powering an induction furnace, any control circuit must be designed with a consideration of the consequence of a short and, accordingly, the elements must be designed to handle a much larger current than they are intended to handle during normal operation. Again, this will involve an undesirable increased expense.

The present invention contemplates a new and improved control circuit for switching power to an induction furnace which is simple in design, economical to manufacture, readily adaptable to a variety of furnace loads, which provides improved filtering of potential harmonic resonances, and is self-limiting current wise if the load is short circuited.

BRIEF SUMMARY OF THE INVENTION

In accordance with the present invention, there is provided a power control circuit for controlling power to a single phase induction furnace from a normal line frequency power supply, the load typically having an inductance and a resistance. The circuit comprises a switch in series connection with the load, a first capacitor in parallel connection with the switch and the load, and a second capacitor in series connection with the switch, the load, and the first capacitor, whereby selective control of operation of conduction of the switch will result in a smooth and continuous control of furnace power.

In accordance with another aspect of the present invention, first and second reactors are provided in series with the first and second capacitors, respectively, to provide a filter for harmonic attenuation and improved system stability throughout the control range. The filter is preferably tuned between a third and fifth harmonic of the power supply.

In accordance with yet another more limited aspect of the present invention, the reactors comprise inductors and the ratio of the capacitor to the inductor in one circuit branch is equal to the ratio of the capacitor to the inductor of the other branch whereby all harmonics are attenuated equally.

One benefit obtained by the current invention is a control circuit which is extremely simple in design and yet possesses desirable operating characteristics for an induction furnace load.

Another benefit is that the control system enables controlling of applied power from zero to one-hundred percent while maintaining a very high system power factor on the line side.

Yet another benefit of the present invention is that it provides for minimization of harmonic resonances in the system whether they are coming from the harmonics generated by the control circuit or picked up from the line side. The subject invention has two advantages in this regard, it will present an anti-resonance circuit on the line side while also acting as an effective filter for the harmonics which are generated by the switch of the control circuit.

Another benefit of the subject invention is that the power circuit is self-limiting with respect to line current. If the load is short circuited the line current will be virtually unaffected. If the switch of the control circuit were to fail, the currents are automatically constrained with a very low level variance.

Yet another benefit of the subject invention is that it avoids the complexity of prior known control systems employing a plurality of thyristors for switching an associated plurality of capacitors.

Other benefits and advantages for the subject new control circuit will become apparent to those skilled in the art upon a reading and understanding of this specification.

BRIEF DESCRIPTION OF THE DRAWINGS

The invention may take physical form in certain parts and arrangements of parts, the preferred and alternative embodiments of which will be described in detail in the specification and illustrated in the accompanying drawings which for a part hereof and wherein.

DETAILED DESCRIPTION OF THE INVENTION

Figure 1:
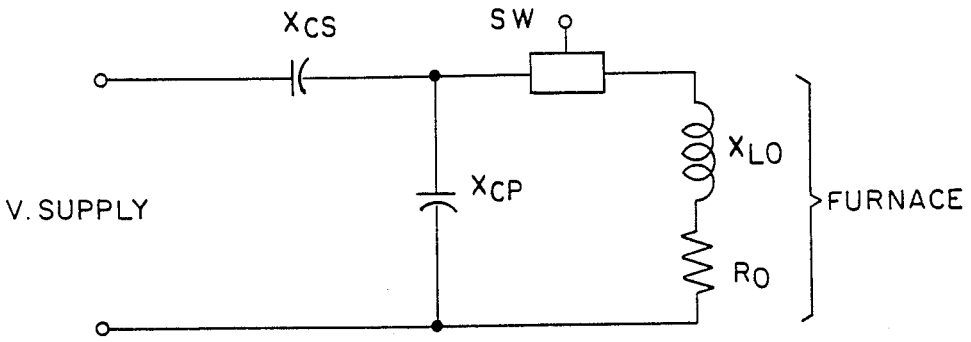
FIG. 1 is a schematic view of a control circuit for an induction furnace formed in accordance with the present invention.

Referring now to the drawings wherein the showing are for purposes of illustrating the preferred and alternative embodiments of the invention only, and not for purposes of limiting same, the FIGURES show a control circuit for switching power to an induction furnace load, the load having an inductive reactance $X_{LO}$ and a resistance $R_O$.

More specifically and with reference to FIG. 1 a circuit for switching the application of power from a voltage supply to an induction furnace or channel furnace having an inductive reactance $X_{LO}$ and a resistance $R_O$ is illustrated. The invention comprises disposal of a very simple single switch in a very advantageous position relative to the furnace load and first and second capacitive circuit branches. A solid state switch comprising thyristors 10, is in series connection with the furnace load. A first capacitor $X_{CP}$ is in parallel connection with the switch 10 and the load. A second capacitor $X_{CS}$, is in series connection with the switch 10, the load, and the first capacitor. The voltage supply preferably comprises a normal line frequency power supply.

The switch 10 is interposed between the furnace, which is a large inductance in itself, and the tuning capacitors, $X_{CP}$, $X_{CS}$. An advantage of this is that since the furnace presents a highly inductive load it is easy to switch. In other words, the prior art systems were troublesome because of the difficulty in switching a capacitor. Since the present invention does not switch capacitors, but rather switches an inductive load, the switching is much easier.

Another unique feature of the circuit is that by choosing judiciously the two capacitors, $X_{CS}$ and $X_{CP}$, it enables control of the power from zero to one-hundred percent while maintaining a very high system power factor on the line side.

Figure 4:
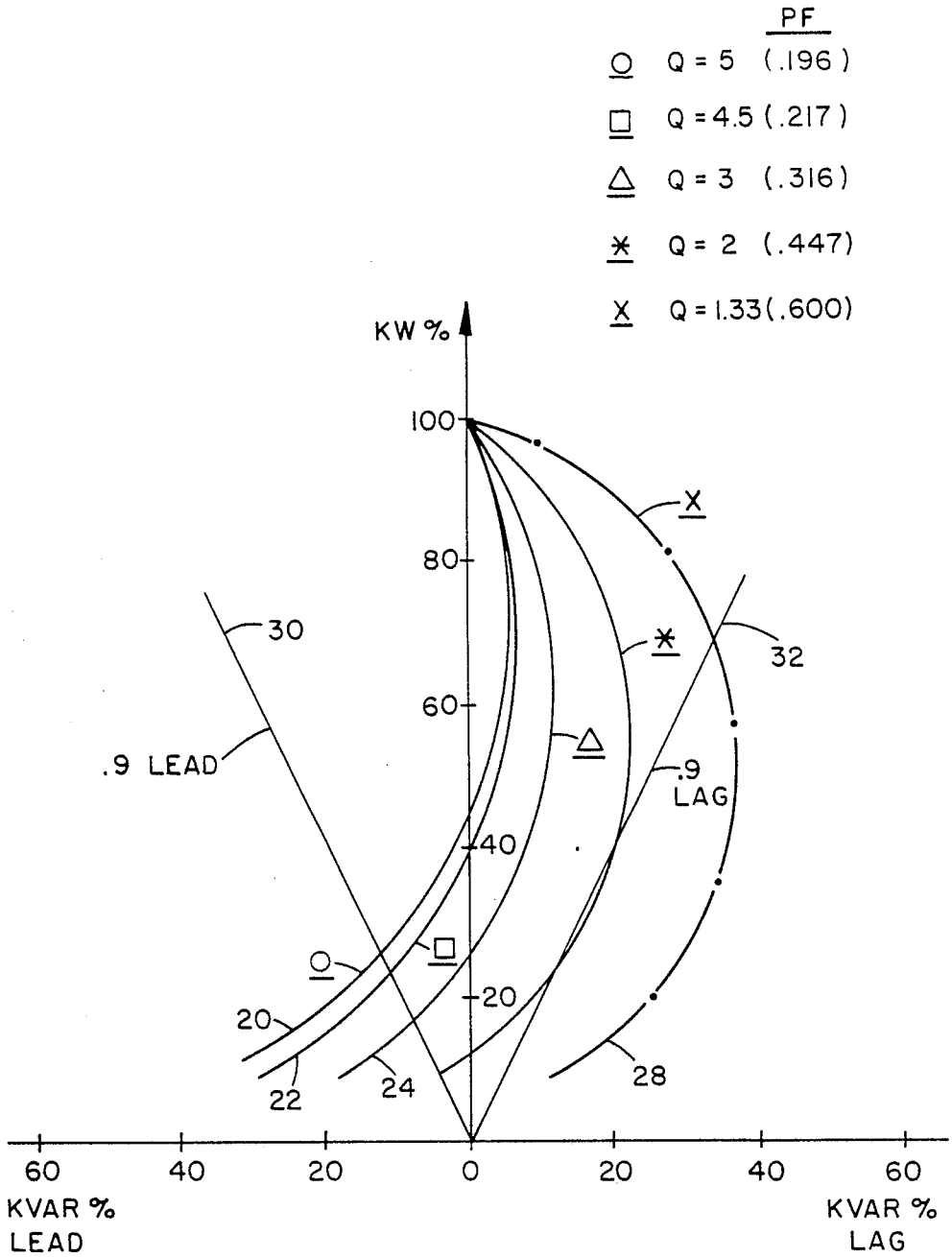
FIG. 4 is a graphical representation of the operating characteristics of the subject invention.

With reference to FIG. 4, the operating characteristics of a circuit formed in accordance with the present invention are illustrated and it can be seen that for various loads, the line power factor is maintained essentially within plus or minus ninety percent as the power is controlled from one-hundred percent down to ten to fifteen percent, which is minimum power. The Q=5 line is 20, Q=4.5 is 22, Q=3 is 24, Q=2 is 26 and Q=1.33 is 28. Lines 30 and 32 determine the area where the line power factor falls between 0.9 lead and 0.9 lag. As it can be seen the line power factor presented to the supply line falls in this area for most of the control range.

The self limiting current feature of the invention can be appreciated if one notes that when the load is shorted, the line current will stay virtually constant due to the effect of $X_{CS}$. If the switch fails the load will only receive full power. If either of the capacitors is shorted, the current is still limited below normal line current value.

Figure 2:
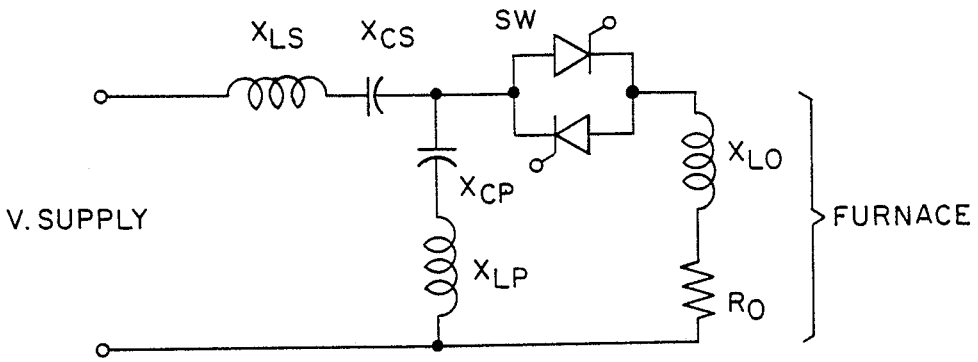
FIG. 2 is an alternative embodiment including additional reactors for improved harmonic filtering of the circuit.

With reference to FIG. 2, additional small inductors, $X_{LS}$ and $X_{LP}$, are interposed in series with the two capacitors, $X_{CS}$ and $X_{CP}$, to provide a filter for harmonics generated in the system. Preferably the filter is tuned between the third and fifth harmonic. By selecting the fourth harmonic as the tuned frequency it allows the circuit to be an effective filter for the third and fifth harmonic and some of the higher harmonics. Although FIG. 2 illustrated inductors in series with the capacitors for tuning it is within the scope of the invention to employ other known reactor means for tuning and harmonic attenuation which would similarly provide improved system stability throughout a control range.

Figure 3:
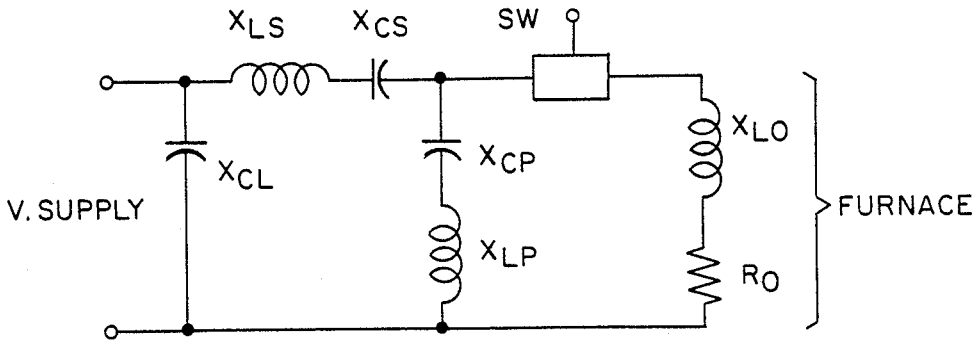
FIG. 3 is another alternative embodiment including an additional capacitive branch in parallel with the elements of the circuit of FIG. 2.

FIG. 3 is another variation of the invention which shows a third circuit branch 12 comprising an additional capacitor, $X_{CL}$, in parallel with the circuit branch comprising the load and switch in series, a second circuit branch including the parallel connected capacitor $X_{CP}$ and a third circuit branch including the series capacitor $X_{CS}$. The circuit of FIG. 3 is advantageous when it is necessary to hold the power factor at a value higher than 0.9 or if you have extreme loads whose power factor is difficult to handle. An interesting special configuration is when the ratio of the capacitor to the inductor of the series connected branch is equal to the ratio of the capacitor to the inductor of the parallel branch. In other words, when $X_{CS}/X_{LS}$ equals $X_{CP}/X_{LP}$. Under this condition all harmonics are attenuated equally.

The invention has been described with reference to the preferred and alternative embodiments. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. Power control means for controlling power to a single-phase induction furnace from a normal line frequency power supply, said load having an inductive reactance and a resistance, comprising:

switch means in series connection with said load;

first capacitive means in parallel connection with said series connected switch means and said load;

second capacitive means in series connection with said series connected switch means and said load and first capacitive means, whereby selective control of operation of conduction of the switch means results in smooth and continuous control of furnace power.

2. The power control means as defined in claim 1 further including filter means tuned between a third and fifth harmonic of the power supply.

3. The power control means as defined in claim 2 wherein the filter means is tuned to a fourth harmonic of the power supply.

4. The power control means as defined in claim 2 wherein the filter means comprises first reactor means in series with said first capacitive means, and second reactor means in series with second capacitive means for harmonic attenuation and improved system stability throughout a control range.

5. Power control means as define in claim 1 further including third capacitive means parallel to the power supply.

6. Power control circuit means for electrical power distribution to an induction heating furnace from a line frequency voltage supply comprising:

a first circuit branch including a furnace load and a switch means in series connection;

a second circuit branch including a capacitor in parallel connection to the first circuit branch; and, a third circuit branch including a capacitor in series with the first and second circuit branches.

7. The power control circuit means as defined in claim 6 including harmonic filtering means comprising first and second inductors included in the second and third circuit branches, respectively, said harmonic filtering means being tuned to a fourth harmonic of the voltage supply.

8. The power control circuit means as defined in claim 7 wherein a ratio of the capacitor to the inductor of the second branch is equal to a ratio of the capacitor to the inductor of the third branch whereby all harmonics are attenuated equally.

9. The power control circuit means as defined in claim 7 further including a fourth circuit branch parallel to the voltage supply having a capacitor for further improvement of the line power factor.

* * * * *